US008217921B2

(12) United States Patent
Hong et al.

(10) Patent No.: US 8,217,921 B2
(45) Date of Patent: Jul. 10, 2012

(54) FLAT PANEL DISPLAY AND DRIVING METHOD OF THE SAME

(75) Inventors: Young Jun Hong, Daegu (KR); Sujin Baek, Geoji-si (KR)

(73) Assignee: LG Electronics Inc., Seoul (KR)

( * ) Notice: Subject to any disclaimer, the term of this patent is extended or adjusted under 35 U.S.C. 154(b) by 1252 days.

(21) Appl. No.: 11/707,047

(22) Filed: Feb. 16, 2007

(65) Prior Publication Data

US 2008/0122873 A1 May 29, 2008

(30) Foreign Application Priority Data

Nov. 29, 2006 (KR) ..... 10-2006-0119394

(51) Int. Cl.
*G09G 3/36* (2006.01)
*G09G 5/00* (2006.01)

(52) U.S. Cl. ..... 345/204; 345/690

(58) Field of Classification Search ..... 345/204, 345/690–693, 694, 60–104
See application file for complete search history.

(56) References Cited

U.S. PATENT DOCUMENTS 6,987,499 B2 1/2006 Yamaguchi et al.
7,355,577 B1 * 4/2008 Bell et al. ..... 345/87
7,768,487 B2 8/2010 Jeon
7,932,916 B2 4/2011 Kim et al.
2005/0078064 A1 * 4/2005 Min et al. ..... 345/76
2005/0253784 A1 * 11/2005 De Greef et al. ..... 345/63
2006/0284899 A1 * 12/2006 Kimura ..... 345/690
2008/0316232 A1 * 12/2008 Ryu et al. ..... 345/690
2009/0195569 A1 * 8/2009 Smits et al. ..... 345/694

FOREIGN PATENT DOCUMENTS

JP 2001-147667 6/2001
JP 2003-015612 1/2003
JP 2006-053536 2/2006
JP 2006-189826 7/2006

OTHER PUBLICATIONS

Japanese Office Action issued in JP Application No. JP 2007-042437 dated Sep. 21, 2011.

* cited by examiner

*Primary Examiner* — Seokyun Moon
(74) *Attorney, Agent, or Firm* — KED & Associates, LLP

(57) ABSTRACT

A flat panel display and a diving method of the same are provided. The flat panel display comprising a controller that comprises a processing unit for processing a digital signal corresponding to one frame to n number of digital sub-frame signals, a driver that receives the digital sub-frame signals from the controller to generate the n number of analog sub-frame signals and supplies the analog sun-frame signals to a display unit, and a display unit that receives the analog sub-frame signals to embody images, wherein an average of brightness corresponding to the n number of digital sub-frame signals is substantially equal to brightness of the digital signal corresponding to one frame, and the number of bits of digital sub-frame signals is smaller than that the number of bits of the digital signal.

10 Claims, 3 Drawing Sheets

FLAT PANEL DISPLAY AND DRIVING METHOD OF THE SAME

This application claims priority to and the benefit of Korea Patent Application No. 10-2006-0119394, filed on Nov. 29, 2006, the entire content of which is incorporated herein by reference.

BACKGROUND

1. Field

This document relates to a flat panel display and a driving method of the same.

2. Related Art

Recently, a flat panel display (FPD) increases its importance with development of multimedia. Accordingly, various flat panel displays such as a liquid crystal display (LCD), a plasma display panel (PDP), a field emission display (FED), and an organic light emitting device are used.

Among them, flat panel displays whose each sub-pixel is formed in an area in which the N×M number of data lines and scan lines intersect in a matrix form receive a data signal and a scan signal from a driver electrically connected thereto, thereby expressing a desired image.

In order to improve an image quality of the flat panel display, various gray scales should be able to express and in order to express various gray scales, the number of bits of a digital data signal is increased. However, in order to embody various gray scales, the output bit number of the driver should be also increased, whereby a device restriction problem according to a gray scale expression generates

SUMMARY

An object of this document is to provide a flat panel display and a driving method thereof that can solve a device restriction problem by decreasing an output bit of a driver through processing a digital signal into the n number of digital sub-frame signals and transmitting the processed n number of digital sub-frame signals.

In an aspect, a flat panel display comprising: a controller that comprises a processing unit for processing a digital signal corresponding to one frame to n number of digital sub-frame signals; a driver that receives the digital sub-frame signals from the controller to generate the n number of analog sub-frame signals and supplies the analog sun-frame signals to a display unit; and a display unit that receives the analog sub-frame signals to embody images, wherein an average of brightness corresponding to the n number of digital sub-frame signals is substantially equal to brightness of the digital signal corresponding to one frame, and the number of bits of digital sub-frame signals is smaller than that the number of bits of the digital signal.

In another aspect, a driving method of a flat panel display comprising: supplying a scan signal to a display unit comprising sub-pixels positioned at an intersection area of scan lines and data lines through the scan lines; processing a digital signal corresponding to one frame supplied from the outside to the n number of digital sub-frame signals; and converting the n number of digital sub-frame signals into the n number of analog sub-frame signals and supplying the n number of analog sub-frame signals to the display unit through the data lines, wherein an average of brightness corresponding to the n number of digital sub-frame signals is substantially equal to brightness of the digital signal before being processed; and the number of bits of the n number of digital sub-frame signals is smaller than that of the digital signal.

BRIEF DESCRIPTION OF THE DRAWINGS

The implementation of this document will be described in detail with reference to the following drawings in which like numerals refer to like elements.

DETAILED DESCRIPTION

Figure 1:
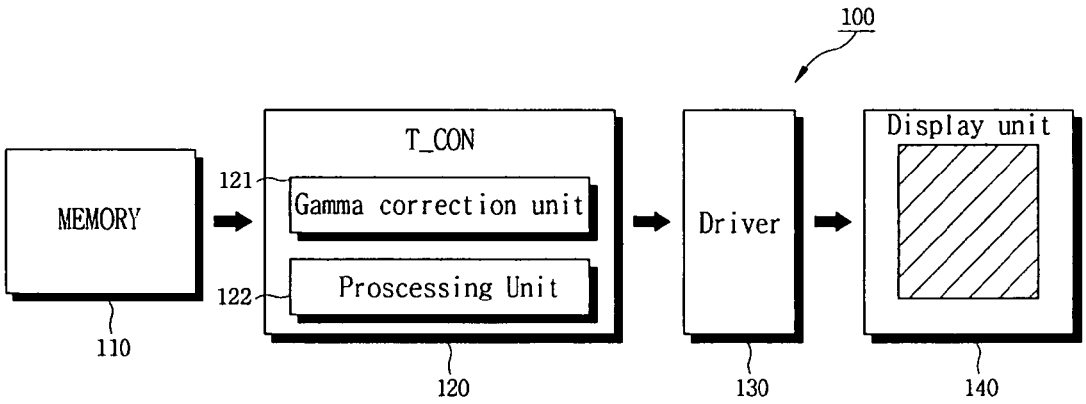
FIG. 1 is a block diagram of a flat panel display in an implementation of this document.

An implementation of this document will be described with reference to the accompanying drawings. However, this document is not limited to an implementation described below, but may be embodied in a variety of forms. In the drawings, if it is mentioned that a layer is positioned on a different layer or a substrate, the layer may be formed directly on the different layer or the substrate, or another layer may be interposed therebetween. Like reference numerals designate like elements.

FIG. 1 is a block diagram of a flat panel display in an implementation of this document.

The flat panel display 100 shown in FIG. 1 comprises a memory 110, a controller 120, a driver 130, and a display unit 140. The memory 110 stores a video signal received from the outside as a digital signal, and each digital signal corresponds to one frame.

The controller 120 comprises a gamma correction unit 121 for correcting a digital signal corresponding to one frame received from the memory 110. The controller 120 comprises a processing unit 122 for processing digital signals gamma-corrected to generate the n number of digital sub-frame signals.

An average of brightness corresponding to the n number of digital sub-frame signals processed by the processing unit 122 is substantially equal to brightness of a digital signal corresponding to one frame before being processed, and the number of bits of the n number of digital sub-frame signals are smaller than that of the digital signal.

The n number of digital sub-frame signals are supplied to the driver 130, and the driver 130 converts the n number of digital sub-frame signals to the n number of analog sub-frame signals and supplies each of the n number of analog sub-frame signals to the display unit 140 during the n number of sub-frames.

The display unit 140 comprises sub-pixels positioned at an intersection area of the scan lines and the data lines. Each sub-pixel may comprise a first electrode, a second electrode, and an organic light emitting layer or a liquid crystal layer positioned between the first electrode and the second electrode. That is, a flat panel display may be an organic light emitting display or a liquid crystal flat display. Further, each sub-pixel may comprise at least one thin film transistor and capacitor.

The display unit 140 embodies an image corresponding to the n number of digital sub-frame signals during the n number of sub-frames, and brightness embodied during one frame can be substantially equal to brightness corresponding to a digital signal corresponding to one frame stored in a memory.

Figure 2:
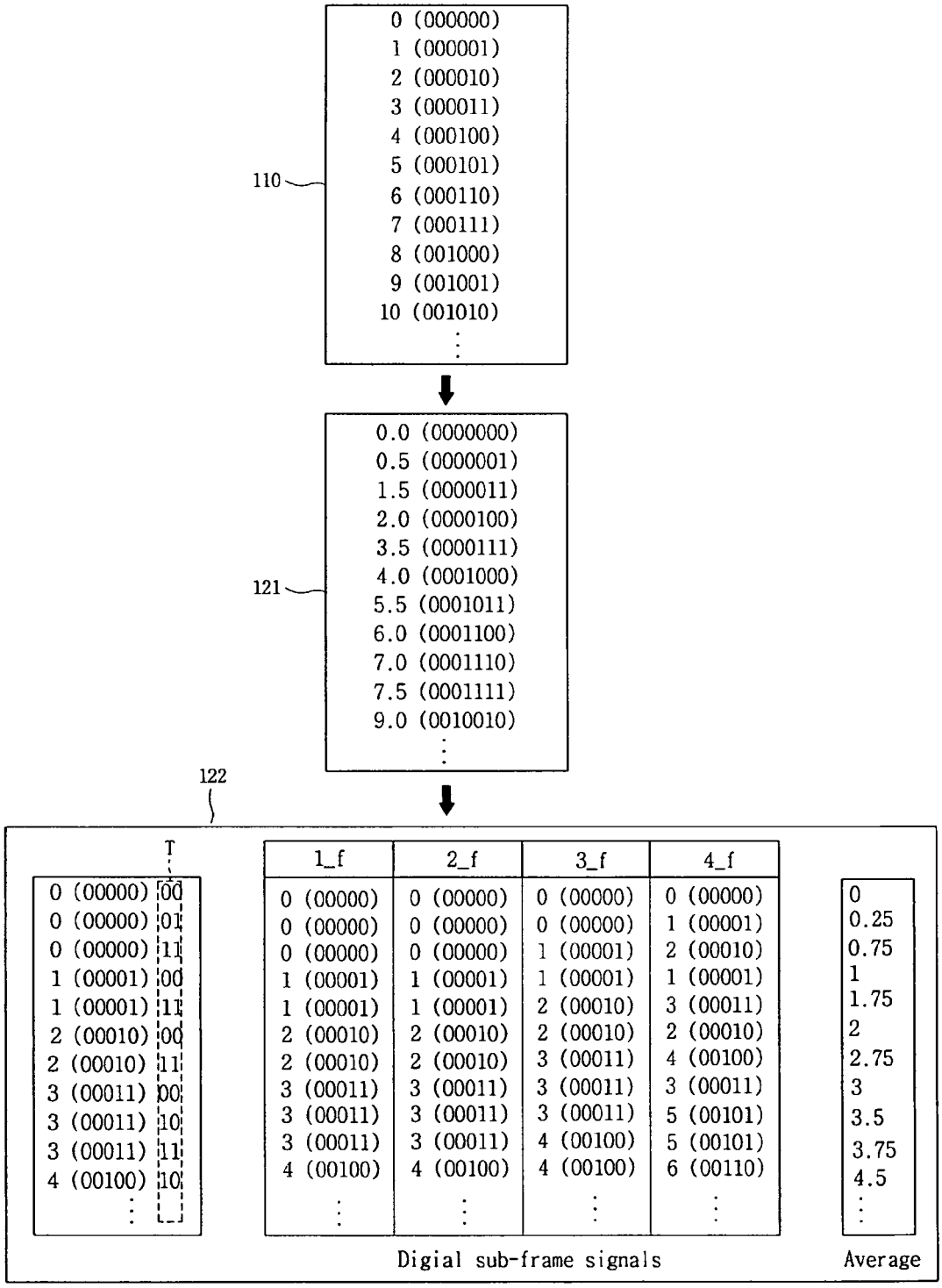
FIG. 2 is a block diagram illustrating a digital signal processing in an implementation of this document.

FIG. 2 is a block diagram illustrating a digital signal processing of a flat panel display in an implementation of this document.

For better comprehension and ease of description of this document, a digital signal corresponding to one frame stored in the memory 110 is defined to 6 bits. A digital signal output from the gamma correction unit 121 of the controller 120 is defined to 7 bits, and the n number of digital frame signals output through the processing unit 122 is defined to 5 bits. However, this document is not limited to the number of bits of the previously defined signal.

Referring to FIG. 2, a 6 bit digital signal stored in the memory 110 is output to the gamma correction unit 121. The gamma correction unit 121 corrects the digital signals using a gamma curve, which is a kind of a nonlinear transfer function considering characteristics of the flat panel display. The gamma correction unit 121 may comprise a look-up table (LUT), and the digital signals are corrected by the LUT of the gamma correction unit. When the flat panel display is an organic light emitting display, the gamma curve line can be formed to correspond to light emitting characteristics, particularly, characteristics of a light emitting material of an organic light emitting layer.

In an implementation of this document, the gamma correction unit 121 corrects the 6 bit digital signal by increasing the number of bits of a digital signal. Herein, the number of bits of the corrected digital signal is 7 bit.

However, unlike the present implementation, although digital signals are corrected by the gamma correction unit 121, the number of bits of the corrected digital signals may be substantially equal to that before being corrected, and as the number of bits of the corrected digital signals increases, a gray scale can be more minutely expressed.

The 7 bit digital signals output from the gamma correction unit 121 are supplied to a processing unit. In order to reduce the output bit number of the driver, the processing unit 122 processes the 7 bit digital signals to generate four 5 bit digital sub-frame signals by deleting the lower bit of 7 bit digital signals.

The processing unit 122 processes the 7 bit digital signals so that brightness corresponding to the 7 bit digital signals may be substantially equal to brightness corresponding to four 5 bit digital sub-frame signals.

For example, the processing unit 122 generates four 5 bit digital sub-frame signals with 7 bit digital signals. Among them, two digital sub-frame signals are a value cut lower two bits of the 7 bit digital signal, and one digital sub-frame signal is a value which a lower bit of cut two bits is added to the value cut lower two bits of the 7 bit digital signal, and the remaining one digital sub-frame signal is a value which an upper bit of the cut two bits is added to a value cut lower two bits of the 7 bit digital signal.

That is, when lower 2 bits of the 7 bit digital signal corrected through the gamma correction unit 121 are '00', a magnitude of four digital sub-frame signals output through the processing unit 122 are equal during four sub-frames, and when lower 2 bits are '01', '10', or '11', at least one of a magnitude of four digital sub-frame signals output through the processing unit 122 is different.

For better comprehension and ease of description, a series of processes are described using digital signals "3 (000011)", "4 (000100)", and "8 (001001)" among memory values shown in FIG. 2.

First, in an example of the digital signal "3 (000011)", a 6 bit digital signal "3 (000011)" stored in the memory 110 increases by 1 bit through the LUT of the gamma correction unit 121 to be "2 (0000100)". A 7 bit digital signal "2 (0000100)" is processed to generate four digital sub-frame signals.

The four digital sub-frame signals are 5 bit digital signal "1 (00001)" by erasing lower 2 bits of the 7 bit signal. Since lower 2 bits of 7 bits are "00," four digital frame signals are substantially equal to each other. That is, the processing unit 122 outputs "1 (00001), 1 (00001), 1 (00001), and 1 (00001)" during four sub-frames.

An average of four digital sub-frame signals is displayed as "1," but the lowest bit of the digital sub-frame signals has substantially the same value as that of a lower third bit of a digital signal corrected in the gamma correction unit. That is, an average of the corrected digital signal and four digital sub-frame signals is equal as "2." Accordingly, the driver 130 receives four 5 bit digital sub-frame signals and converts four 5 bit digital sub-frame signals to four analog sub-frame signals so that an average of brightness of four 5 bit digital sub-frame signals and brightness of the corrected 7 bit digital signal may be substantially equal to each other.

Accordingly, a data signal quantity substantially supplied to the display unit 140 is substantially equal to "3.5," which is a value of the gamma correction unit 121, and thus brightness thereof is equally embodied in the display unit 140.

Next, as an example, a digital signal "4 (000100)" is described.

The 6 bit digital signal "4 (000100)" of the memory 110 increases by 1 bit by the gamma correction unit 121 to be a 7 bit digital signal "1 (0000111)". The 7 bit digital signal "1 (0000111)" is processed to generate four digital sub-frame signals.

At this time, the processing unit 122 generates two 5 bit digital sub-frame signals "1 (00001)" by cutting lower 2 bits of the 7 bit digital signal "1 (0000111)". Thereafter, a lower bit of the cut 2 bits is added to the 5 bit digital sub-frame signal, and an upper bit of the cut 2 bits is added to the 5 bit digital sub-frame signal, whereby two sub-frame signals are generated. That is, four digital sub-frame signals are "1 (00001), 1 (00001), 2 (00010), and 3 (00011)".

An average of four digital sub-frame signals are described as "1.75," but the lowest bit of the 5 bit digital sub-frame signal is substantially equal to a lower third bit of the 7 bit digital sub-frame signal. That is, an average of the corrected digital signal and four digital sub-frame signals is equal as 3.5. Accordingly, the driver 130 receives four 5 bit digital sub-frame signals and converts four 5 bit digital sub-frame signals to four analog sub-frame signals so that an average of brightness of four 5 bit digital sub-frame signals and brightness of the corrected 7 bit digital signal may be substantially equal to each other.

Accordingly, a data signal quantity substantially supplied to the display unit 140 is substantially equal to "3.5," which is a value of the gamma correction unit 121, and thus brightness thereof is equally embodied in the display unit 140.

Next, as an example, the digital signal "8 (001001)" is described.

A digital signal "8 (001000)" stored in the memory 110 becomes "7 (0001110)" increased by 1 bit through the gamma correction unit 121. The digital signal "7 (0001110)" is processed to generate four digital sub-frame signals through the processing unit 122.

At this time, the processing unit 122 generates two 5 bit digital sub-frame signals "3 (00011)" by cutting lower 2 bits of 7 bits. Thereafter, a lower bit of the cut bits 10 is added to the 5 bit digital sub-frame signal "3 (00011)", and an upper bit of the cut bits 10 is added to the 5 bit digital sub-frame signal "3 (00011)", whereby two digital sub-frame signals are generated. That is, four 5 bit digital sub-frame signals are "3 (00011), 3 (00011), 3 (00011), and 5 (00101)".

Although an average of the digital sub-frame signals is displayed as "3.5," the lowest bit of the 5 bit digital sub-frame signal is substantially equal to a lower third bit of the 7 bit digital sub-frame signal. That is, an average of the corrected digital signal and four digital sub-frame signals is equal as "7." Accordingly, the driver 130 receives four 5 bit digital sub-frame signals and converts four 5 bit digital sub-frame signals to four analog sub-frame signals so that an average of brightness of four 5 bit digital sub-frame signals and brightness of the corrected 7 bit digital signal may be substantially equal to each other.

Accordingly, a data signal quantity substantially supplied to the display unit 140 is substantially equal to "7," which is a value of the gamma correction unit 121, and thus brightness thereof is equally embodied in the display unit 140.

In an implementation of this document, four 5 bit digital sub-frame signals are generated by erasing lowest 2 bits of the digital signal in the 7 bit digital signal, but two 6 bit digital sub-frame signals may be generated by erasing the lowest 1 bit, and the number of digital sub-frame signals is not limited thereto.

Further, in an implementation of this document, in processing the 7 bit digital signal, a method of processing based on a value in which lower 2 bits are deleted is described, but this document is not limited to this method. An average of a plurality of digital sub-frame signals may be substantially equal to the digital signal before being processed. That is, in an implementation of this document, if the 7 bit digital signal is processed to "(1, 1, 2, 3)", the 7 bit digital signal can be processed to "(0, 2, 2, 3)" or "(4, 0, 0, 3)".

The controller 120 can select any one of red color, green color, and blue color digital signals and processes the selected signal to the n number of digital sub-frame signals. Accordingly, in a color in which it is necessary to express more variously a gray scale, the digital signal can be supplied to the display unit by increasing the number of bits of the digital signal through minutely correcting the digital signal by a gamma correction unit and then processing the digital signal to digital sub-frame signals by the processing unit. That is, a screen quality of a flat panel display without increasing the output bit number of the driver can be improved.

Figure 3:
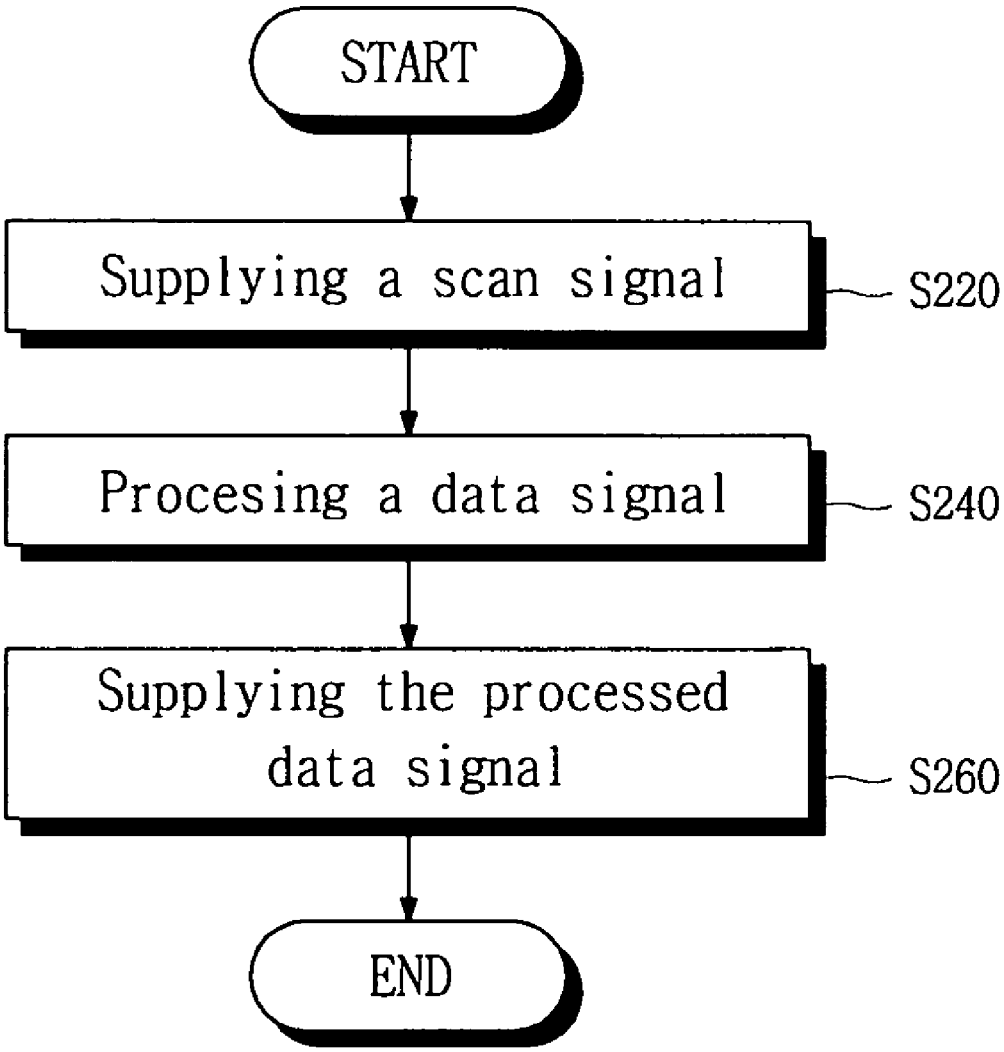
FIG. 3 is a flowchart illustrating a driving method of a flat panel display in an implementation of this document.

FIG. 3 is a flowchart illustrating a driving method of a flat panel display in an implementation of this document.

Referring to FIGS. 1 and 3, the step of supplying a scan signal (S220) is to supply a scan signal to the display unit 140 comprising sub-pixels positioned at an intersecting area of scan lines and data lines through the scan lines.

The step of processing a data signal (S240) is to process one digital signal supplied from the outside to the n number of digital sub-frame signals.

In the step of processing a data signal (S240), the digital signal is gamma-corrected by increasing the number of bits of a digital signal corresponding to one frame by at least one bit using the gamma correction unit 121 comprising the LUT, and the gamma-corrected digital signal can be processed to the n number of digital sub-frame signals by using the processing unit 122.

In the step of supplying a data signal (S240), the driver 130 converts the n number of digital sub-frame signals to the n number of analog sub-frame signals and supplies the n number of analog sub-frame signals to the display unit 140 during the n number of sub-frames so that an average of brightness of the n number of digital sub-frame signals and brightness of the corrected digital signal may be substantially equal to each other.

As described above, in this document, a magnitude of a driver can be decreased or sustained while a gray scale can be variously expressed, so that a device restriction problem according to a gray scale expression can be solved.

The invention being thus described, it will be obvious that the same may be varied in many ways. Such variations are not to be regarded as a departure from the spirit and scope of the invention, and all such modifications as would be obvious to one skilled in the art are intended to be comprised within the scope of the following claims.

What is claimed is:

1. A flat panel display, comprising:

a controller comprising a processing device that processes a digital signal corresponding to one frame to generate n number of digital sub-frame signals; and a driver that receives the digital sub-frame signals from the controller to generate n number of analog sub-frame signals and supplies the analog sub-frame signals to a display, the display receiving the analog sub-frame signals to embody images, wherein an average of brightness corresponding to the n number of digital sub-frame signals is substantially equal to brightness of the digital signal corresponding to one frame, and the number of bits of the digital sub-frame signals is less than the number of bits of the digital signal, and wherein the controller comprises a gamma correction device that corrects the digital signal corresponding to one frame by referring to a lookup table and increasing the number of bits of the digital signal, and wherein the digital signal corresponding to the one frame corrected through the gamma correction device is 7 bits, and the processing device generates four 5 bit digital sub-frame signals by processing the 7 bit digital signal, wherein any three of the four 5 bit digital sub-frame signals are generated by deleting lower 2 bits of the 7 bit digital signal, and a magnitude of a remaining one of the four 5 bit digital sub-frame signals is greater than a magnitude of the any three of the digital sub-frame signals.

2. The flat panel display of claim 1, wherein a magnitude of at least two of the any three of the four 5 bit digital sub-frame signals generated by deleting lower 2 bits of the 7 bit digital signal is less than a magnitude of a remaining two of the four 5 bit digital sub-frame signals, and a magnitude of one of the remaining two of the four 5 bit digital sub-frame signals is greater than a magnitude of the other of the remaining two of the four 5 bit digital sub-frame signals.

3. The flat panel display of claim 1, wherein the driver converts the n number of digital sub-frame signals to the n number of analog sub-frame signals so that brightness in which the n number of digital sub-frame signals display and brightness in which the digital signal displays are substantially equal to each other.

4. The flat panel display of claim 1, wherein the controller processes at least one of red color, green color, and blue color digital.

5. The flat panel display of claim 1, wherein the display comprises sub-pixels positioned at an intersection area of scan lines and data lines; and each sub-pixel comprises a first electrode, a second electrode, and an organic light emitting layer interposed between two electrodes.

6. The flat panel display of claim 5, wherein the each sub-pixel comprises at least one thin film transistor and capacitor.

7. A driving method of a flat panel display, comprising:

supplying a scan signal to a display comprising sub-pixels positioned at an intersection area of scan lines and data lines through the scan lines;

processing a digital signal corresponding to one frame supplied from an outside to n number of digital sub-frame signals; and converting the n number of digital sub-frame signals into n number of analog sub-frame signals and supplying the n number of analog sub-frame signals to the display through the data lines, wherein an average of brightness corresponding to the n number of digital sub-frame signals is substantially equal to brightness of the digital signal before being processed, and number of bits of the n number of digital sub-frame signals is less than number of bits of the digital signal, wherein the processing of the digital signal comprises correcting the digital signal using a gamma correction device having a look-up table and processing the corrected digital signal to the n number of digital sub-frame signals, using a processing device, and wherein the gamma correction device corrects the digital signal by increasing a number of bits of the digital signal, wherein correcting the digital signal using a gamma correction device comprises deleting a lower 2 bits of a 7 bit digital signal corresponding to the one frame, and generating four 5 bit digital sub-frame signals, wherein a magnitude of three of the four 5 bit digital sub-frame signals is less than a magnitude of a remaining one of the four 5 bit digital sub-frame signals.

8. The driving method of claim 7, wherein a magnitude of at least two of the three 5 bit digital sub-frame signals generated by deleting lower two bits of the 7 bit digital signal is less than a magnitude of a remaining two of the four 5 bit digital sub-frame signals.

9. The driving method of claim 7, wherein the n number of digital sub-frame signals are converted to the n number of analog sub-frame signals so that brightness in which the n number of digital sub-frame signals display and brightness in which the digital signal displays are substantially equal to each other.

10. The driving method of claim 7, wherein the digital signal is at least one of red color, green color, and blue color digital signals.

* * * * *